US009888773B2

(12) United States Patent
Davis

(10) Patent No.: US 9,888,773 B2
(45) Date of Patent: Feb. 13, 2018

(54) MODULAR WALL FURNITURE SYSTEM

(71) Applicant: Bradford L. Davis, Holland, MI (US)

(72) Inventor: Bradford L. Davis, Holland, MI (US)

( * ) Notice: Subject to any disclaimer, the term of this patent is extended or adjusted under 35 U.S.C. 154(b) by 283 days.

(21) Appl. No.: 14/596,498

(22) Filed: Jan. 14, 2015

(65) Prior Publication Data

US 2015/0201524 A1 Jul. 16, 2015

Related U.S. Application Data

(60) Provisional application No. 61/927,627, filed on Jan. 15, 2014.

(51) Int. Cl.

| | |
|---|---|
| ***A47B 87/00*** | (2006.01) |
| *E04C 2/52* | (2006.01) |
| *A47B 83/00* | (2006.01) |

(52) U.S. Cl.

CPC ..... *A47B 87/00* (2013.01); *A47B 83/001* (2013.01); *E04C 2/523* (2013.01)

(58) Field of Classification Search

CPC ..... A47B 87/00

USPC ..... 454/184

See application file for complete search history.

(56) References Cited

U.S. PATENT DOCUMENTS

| | | | | |
|---|---|---|---|---|
| 3,953,093 | A * | 4/1976 | Hero | A47B 77/02 312/245 |
| 5,947,105 | A * | 9/1999 | Scott | F24B 1/202 126/25 R |
| 6,286,275 | B1 * | 9/2001 | Edwards | E04B 2/7422 52/220.2 |
| 8,113,009 | B2 * | 2/2012 | Kuriyama | H05K 7/20745 361/696 |
| 2008/0284292 | A1 * | 11/2008 | Castelluccio | A47B 85/08 312/107 |
| 2014/0083412 | A1 * | 3/2014 | Chtchetinin | F24C 15/2092 126/299 D |

* cited by examiner

*Primary Examiner* — Steven B McAllister
*Assistant Examiner* — Allen Schult
(74) *Attorney, Agent, or Firm* — Warner Norcross & Judd LLP

(57) ABSTRACT

A modular wall system having an integrated air flow path that provides cooling of heat generating component housed within the system. In one embodiment, the modular wall system includes wall vertical brackets that create one or more vertical flues, as well as ventilated base cabinets that are configured to direct the flow of air over component stores within. The top of the wall system may be vented allow to heat rising through the flues to vent into the surrounding atmosphere. The bottom of the base cabinets may be ventilated to allow air to enter the interior cabinet from the surrounding environment. The rear of the base cabinets may be open to the flue to allow air to flow from the interior of the cabinet up through the flues. The doors of the base cabinets may also be ventilated to provide additional air flow.

29 Claims, 13 Drawing Sheets

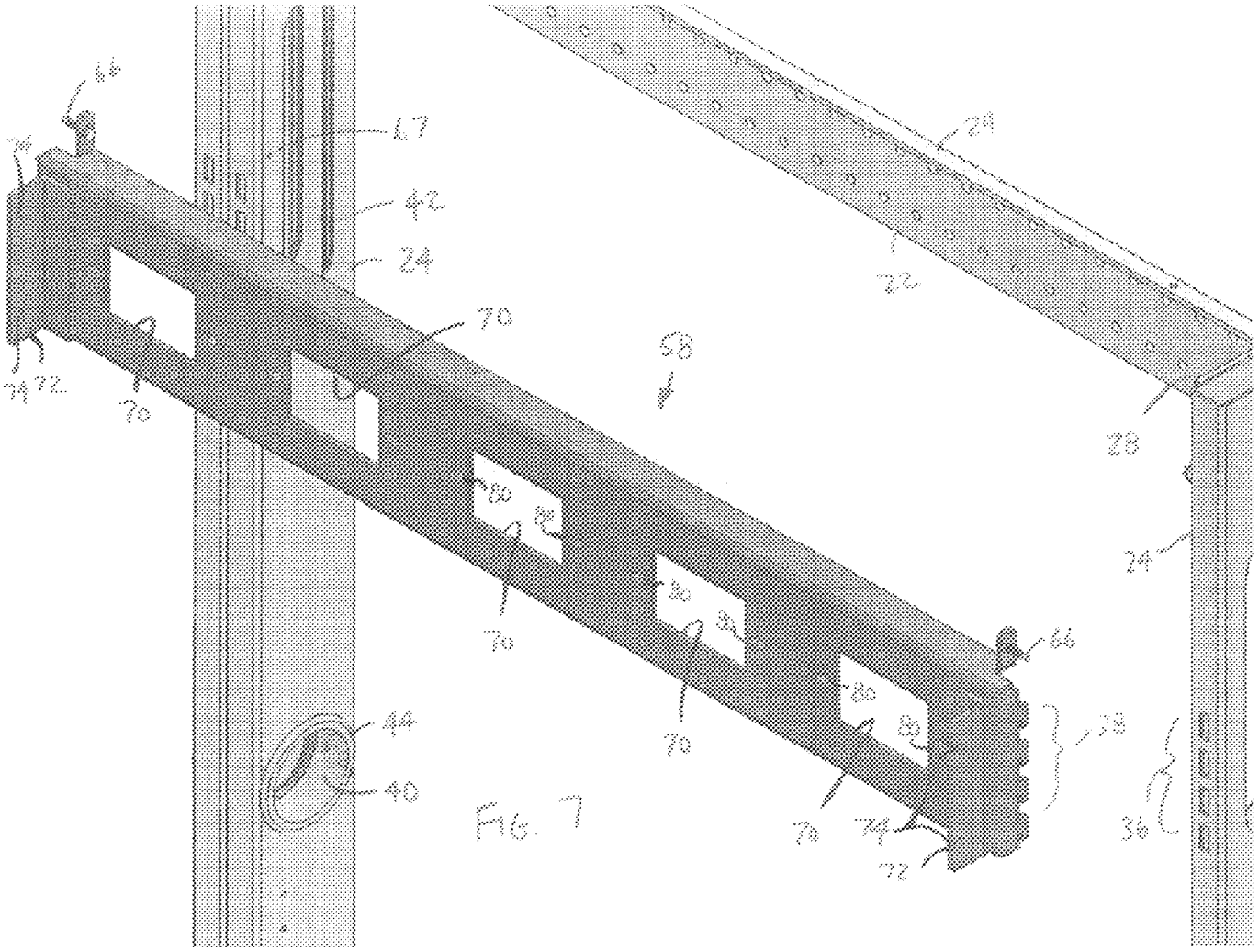
24
72
68
70
42
24
44
40
44
72
74
76
78
78
78

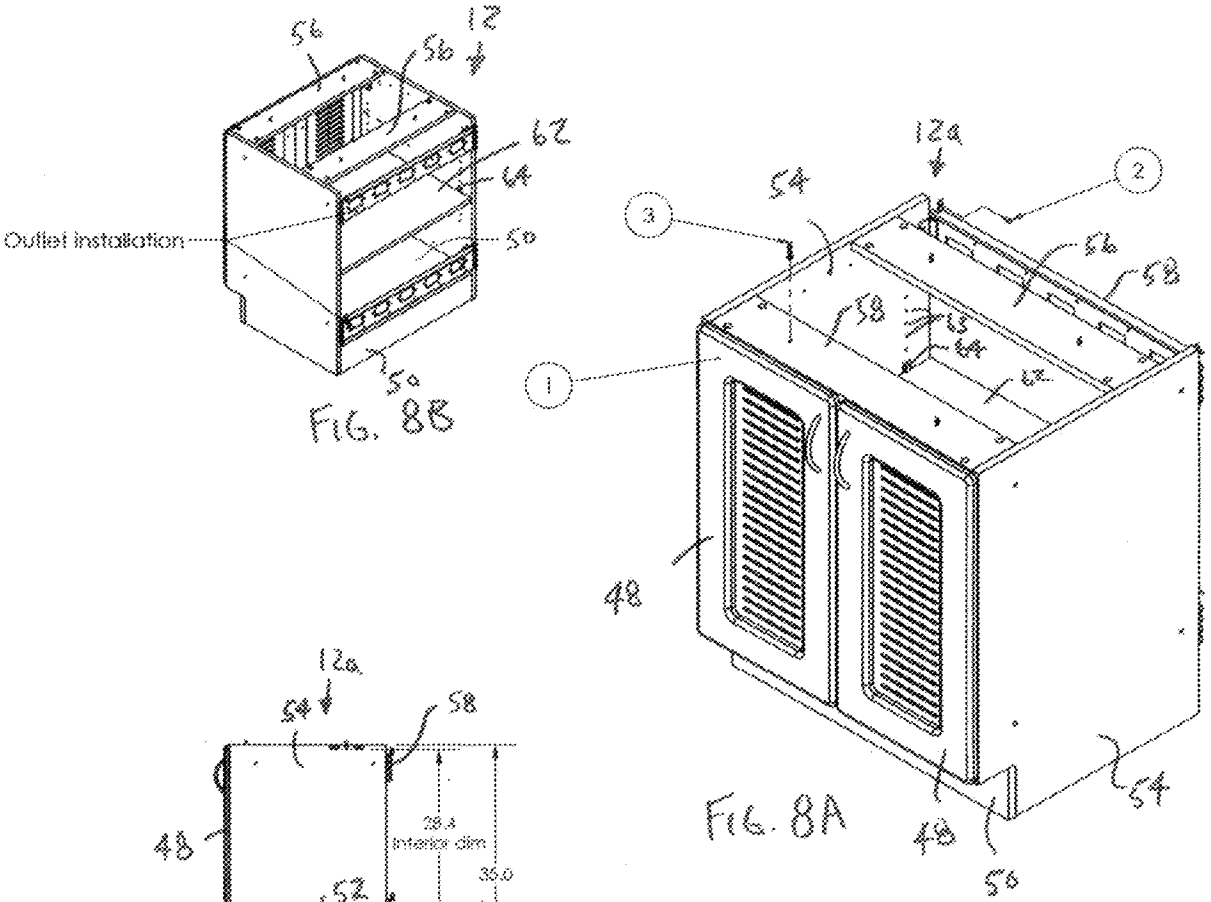
FIG. 8A
FIG. 8B
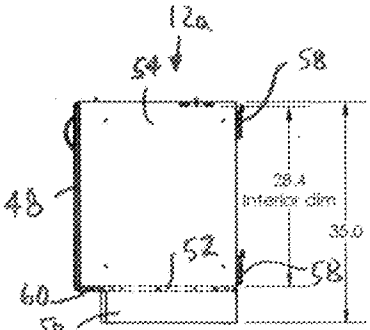
FIG. 8C

MODULAR WALL FURNITURE SYSTEM

BACKGROUND OF THE INVENTION

The present invention relates to modular wall systems and more particularly to modular wall systems intended to house electronics and/or other components that generate heat.

A wide variety of modular wall furniture systems are available on the market. Conventional modular wall systems include modular cabinets, shelves and other components that can be assembled in a variety of alternative arrangements on a series of wall brackets or similar mounting structures. One existing modular wall systems includes horizontal rails and vertical brackets. The horizontal rails are secured to an existing wall, for example, by fasteners extending through horizontal brackets into the wall studs. The vertical brackets are mounted to the horizontal rails, for example, the vertical brackets may fit over mounting contours in the horizontal rails. The cabinets, shelving and other components are mounted to the vertical brackets. To facilitate assembly, the cabinets, shelving and other components include mounting features that are interfitted with corresponding mounting features in the vertical rackets. The mounting features may be configured so that the cabinets, shelving and other components may be easily attached to the vertical brackets at a variety of different heights. For example, the vertical brackets may include a plurality of mounting slots and the cabinets, shelving and other components may include hooks that are fitted into the slots as desired.

It is often desirable to house electronics or other heat-generating components in the cabinetry of a modular wall system. For example, in a hospital environment, it is not uncommon to house computers, routers, medical diagnostic equipment and other expensive medical electronics in modular wall systems. With conventional modular wall systems, this can present significant problems associated with heating. More specifically, conventional modular wall systems retain heat and, in applications in which the electronics or other components generate significant heat, there is a possibility that the components will heat to the point where performance is affected or damage to components occurs.

Efforts have been made to provide ventilation in cabinets intended for use in housing electronics. In some applications, the cabinets are provided with doors that are vented. Although door vents allow some air movement and therefore provide some cooling, they are not alone sufficient to provide proper ventilation in many applications. In other applications, electronics and other heat-generating components are housed in cabinets that do not contain doors. This provides improved ventilation, but creates other problems. For example, security issues arise when expensive equipment is not housed in a locked cabinet. Unauthorized personal may view confidential information displayed on the equipment, may tinker with accessible controls on the equipment or even steal the equipment. As another example, aesthetic issues arise when a cabinet does not include doors that could be closed to hide a collection of wires, manuals and component accessories.

SUMMARY OF THE INVENTION

The present invention provides a modular wall system having an integrated air flow path that provides cooling of electronics and other heat generating component housed within the system. In one embodiment, the modular wall system includes wall brackets that create one or more vertical flues (or chases), as well as cabinets that are configured to draw in air, direct the flow of air over housed components and vent that air through the flues. In one embodiment, the wall brackets are elongated vertical brackets that extend a sufficient distance from the wall to create a flue of appropriate cross-sectional area to allow the desired amount of air flow. In one embodiment, the top of the wall system may be vented to allow heat rising through the flues to vent into the surrounding atmosphere.

In one embodiment, the wall system includes a framework that is assembled from a plurality of modular frame assemblies. In one embodiment, the framework includes upper and lower frame assemblies that can be joined to one another to provide the desire support structure for the wall system. Upper and lower frame assemblies may be joined by internal connectors. Side-by-side frame assemblies may be joined by fasteners, such as bolts.

In one embodiment, the framework includes a plurality of horizontal supports (e.g. horizontal rails). The horizontal supports may be configured to mount to an existing wall, such as to existing wall studs. In such embodiments, the horizontal supports may include mounting holes that allow the horizontal supports to be secured to existing wall studs by fasteners, such as bolts or screws. The horizontal supports may include a large array of offset mounting holes so that at least one of the mounting holes is aligned with each wall stud. The horizontal supports may be joined to the vertical brackets during manufacture to provide frame assemblies so that the components need not be assembled on site. For example, in one embodiment, the horizontal supports and vertical brackets may be welded together during manufacture to form modular frame assemblies that can be joined together on-site to form the complete framework.

In one embodiment, the wall system includes one or more base cabinets that are capable of being mounted to the wall brackets at or near the floor. Each base cabinet may be in fluid communication with the flue defined by the corresponding wall brackets. This provides an air flow path for heat generated by components within the cabinet to flow out of the cabinet, into the flue and out of the top of the wall system. In some applications, the cabinet may include a rear wall. If so, the rear wall may be sufficiently perforated to allow air to flow from the interior of the cabinet into the flue. In other applications, the cabinet may not include a rear wall and interior of the cabinet may simply be open to the flue. In some applications, a base cabinet may not be intended for use with heat generating components. In such applications, the base cabinet may include a rear wall. Even if not ventilated, the rear wall of the base cabinet may include openings for wires, cords and other items that might be routed through the flue.

In one embodiment, the base cabinet may include a pedestal that rests on the floor and a bottom panel that is positioned above the pedestal to form the bottom surface of the interior of the cabinet. The bottom panel may include a forward overhang that extends forwardly beyond the forward-most extent of the pedestal. The forward overhang may be perforated to provide an inlet vent to allow air to enter the interior of the cabinet from the surrounding environment. In use, the ventilated forward overhang causes air to enter the interior of the cabinet at the lower front, which allows air to flow over and cool components housed in the cabinet as it flows upwardly and rearwardly from the inlet to the flue.

In one embodiment, the base cabinet may include one or more ventilated doors. The ventilated doors may allow air to enter the interior of the cabinet from the surrounding environment. This air may be drawn over components housed in the cabinet as it flows to the flue. Ventilated doors may be used in addition or as an alternative to perforations in the forward overhang of the cabinet bottom.

In one embodiment, the base cabinet may be suspended above the floor, and the floor may be ventilated to allow air to enter the system and flow across the electronic components. The floor ventilation may be positioned toward the front of the cabinet to help increase the length of the air flow path over the components.

In one embodiment, the wall system includes base cabinets, riser sections and upper cabinets. The riser section may include access panels that mount to and cover the vertical brackets to maintain a closed flue from the base cabinets to the upper cabinets.

In one embodiment, the upper cabinets are configured to mount to the vertical brackets. When an upper cabinet is not intended to house heat-generating components, the upper cabinet may include a rear wall. The rear wall may be provided with one or more openings to allow wiring to enter the upper cabinet from the flue. When an upper cabinet will house heat-generating components, the upper cabinet may include ventilation in the doors and/or in the bottom panel to allow air to enter the cabinet, and the upper cabinet may include no rear wall or it may include a rear wall that is sufficiently perforated to allow adequate air flow from the interior of the upper cabinet into the flue.

In one embodiment, the top of the system may include a headspace and one or more ventilation caps that allow air flowing up the flues to vent into the environment. The ventilated cap may be mounted at an angle for aesthetic purposes and to allow increased surface area for ventilation openings. The ventilation cap may include ventilation openings that direct air upwardly and outwardly.

In one embodiment, the vertical brackets include a plurality of traverse wiring holes that allow cords, wires, supply lines and other items to be run throughout the system. The wiring holes may be fitted with grommets to protect wires and other items passing through the wiring holes.

In one embodiment, a fan can be provided to increase air flow through the ventilation system. For example, a fan may be provided in the headspace to move air from the interior to the environment. As another example, a separate fan may be include in each flue (or elsewhere in the flow path) in which improved airflow is desired. In applications where heat generating components will be contained in a single cabinet, a fan may be positioned in the cabinet or in the flue associated with that cabinet. In some applications, a fan may not be permissible, such as in a surgical environment. In such applications, the wall system may rely solely on natural convection to move air into the cabinets, over the components and out through the flue and ventilation cap.

The present invention provides a modular wall furniture system with an integrated natural convection cooling system that draws air from close to the floor and vents it at the top of the wall system. The significant heat generated by the electronic components powers the natural convection drawing air from the coldest area of the room (close to the floor) and venting it at the top of the wall system. The wall system includes vertical brackets that not only provide a support structure for hanging cabinets, shelves and other components, but also defines an air flow path of sufficient depth and width to allow adequate air flow. The inlets and flue are arranged to draw air over housed electronics and other heat-generating components to provide enhanced cooling. The inlets may be incorporated into the base cabinets in the bottom panel and/or in the door, thereby providing various base cabinet design options. The base cabinets may communicate with the flue through the absence of a rear panel or by incorporating sufficient perforations in the rear panel. When included, the angled upper vent provides a headspace that functions as a large plenum above the various flues, as well as enhances surface area for venting from flue in an upwardly and forwardly direction. The use of removable access panels between the base cabinets and upper cabinets provides a simple and effective structure for maintaining a closed flue between cabinets. Ventilation can be easily added to upper cabinets when it is desirable for them to house heat-generating components. The use of a framework with preassembled frame assemblies (e.g. pre-joined horizontal rails and vertical brackets) greatly simplifies installation as compared to systems in which horizontal and vertical components must be separately installed on-site. The framework can be configured so that, once installed, the cabinets, access panels, beauty panels and venting hardware simply clip or screw into hole patterns on the framework. The cabinet mounting brackets may include set screws or other fasteners that lock the mounting brackets to the framework to improve system strength and integrity.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION OF THE DRAWINGS

FIG. 7 is a perspective view of a mounting bracket.

FIG. 8A is a front perspective view of a base cabinet.

FIG. 8B is a rear perspective view of a base cabinet.

FIG. 8C is a side view of a base cabinet.

DESCRIPTION OF THE CURRENT EMBODIMENT

Figure 2:
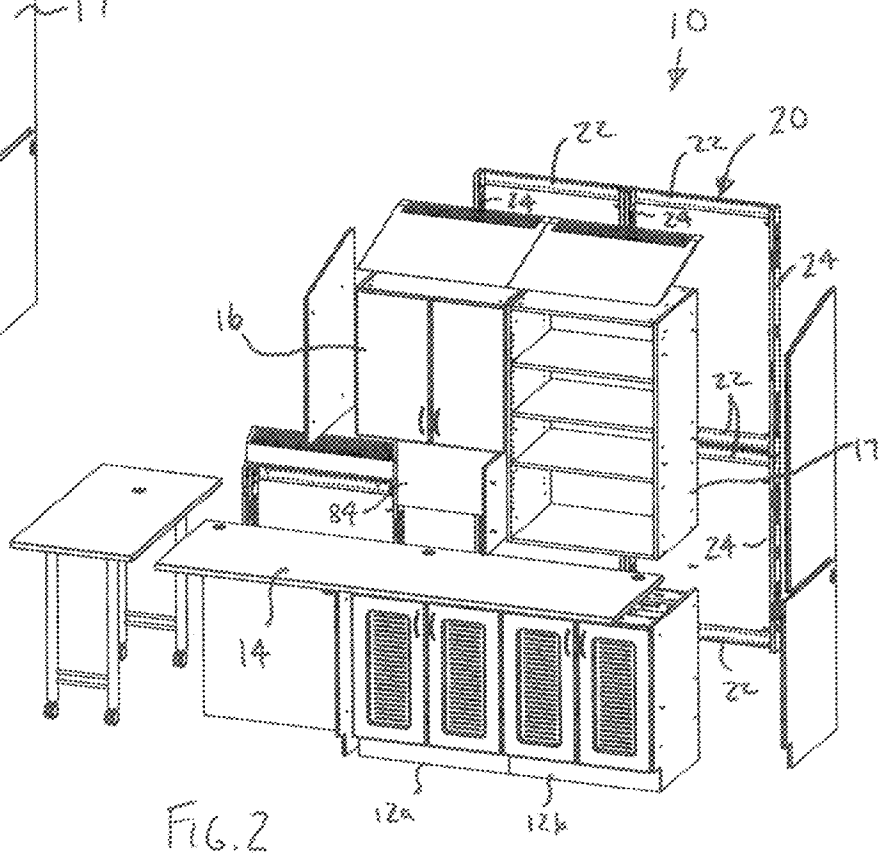
FIG. 2 is a partially exploded perspective view of the wall system.
Figure 1:
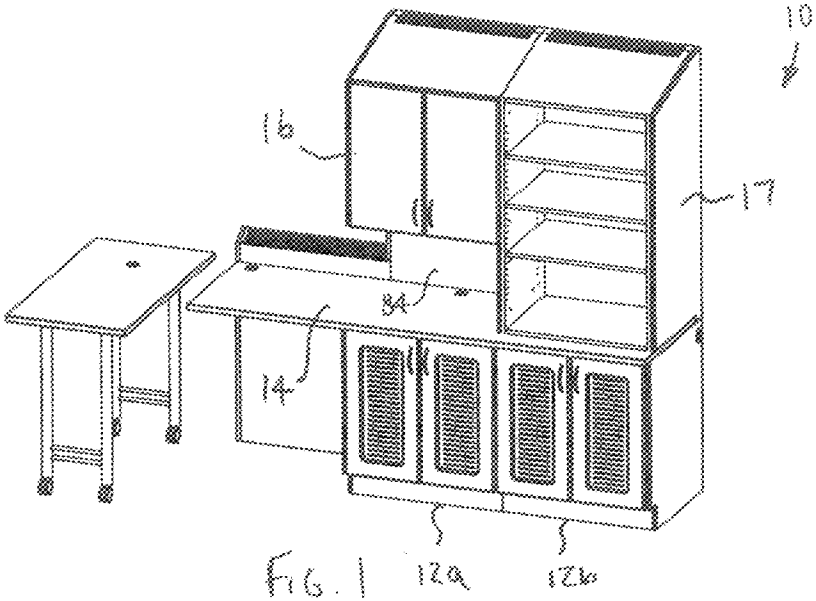
FIG. 1 is a perspective view of a wall system in accordance with an embodiment of the present invention.
Figure 3C:
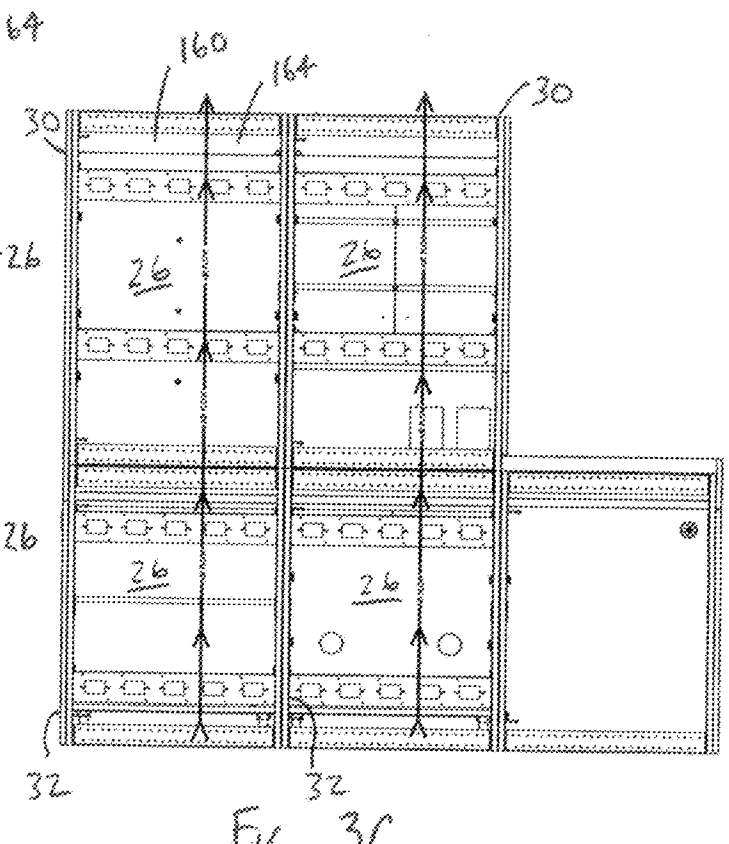
FIG. 3C is a rear view of the wall system annotated to show the air flow path.
Figure 3B:
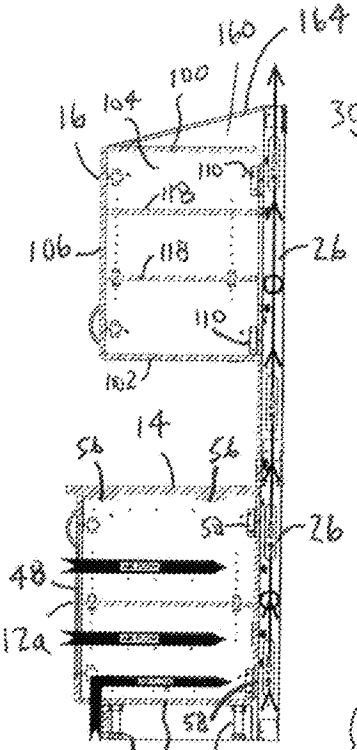
FIG. 3B is a sectional view of the wall system taken along line 3B-3B of FIG. 3A with annotations to show the air flow path.
Figure 3A:
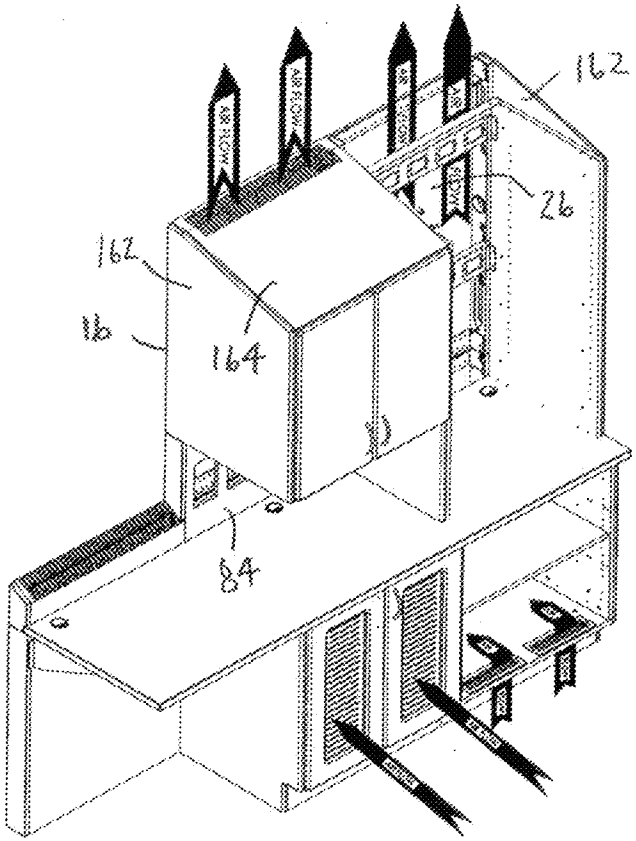
FIG. 3A is a perspective view of the wall system with portions removed and annotated to show the air flow path.

A modular wall furniture system in accordance with an embodiment of the present invention is shown in FIG. 1. In this embodiment, the wall system 10 includes a plurality of base cabinets 12*a-b*, a work surface 14, a standard upper cabinet 16 and a tall upper cabinet 17. The wall system 10 includes a framework 20 that is mounted to a wall. The framework 20 includes an arrangement of horizontal rails 22 and vertical brackets 24. The horizontal rails 22 and vertical brackets 24 may be preassembled in modular frame assemblies 30, 32 to facilitate on-site installation. The various components of the wall system 10 are configured so that they collectively provide an air flow path that allows air to enter the wall system 10, flow over any heat-generating components housed in the base cabinets 12*a-b* and vent through from the top of the wall system 10. In the illustrated embodiment, the vertical brackets 24 are configured to define vertical flues 26 that allow air from the cabinets 12*a-b* to flow up through appropriate venting a top the system 10. The air flow paths may best be seen in FIGS. 3A-3C, which show the wall system 10 with various components removed. More specifically, FIGS. 3A-C show the doors 48 removed from base cabinet 12*a*, the tall upper cabinet 17 and its associated rear wall removed and the ventilation cap 164 associated with the tall upper cabinet 17 removed. Various arrows have been added to FIGS. 3A-C to illustrate the air flow paths through the flues 26 associated with base cabinets 12*a* and 12*b*.

Although the wall system 10 is modular by design, the illustrations show various modular components arranged in one particular configuration. It should be understood that the wall system may be configured with the illustrated (and otherwise disclosed) base cabinets, work surfaces, upper cabinets, extended countertop supports and shelving arranged in a wide variety of alternative configurations. Further, in additional to the illustrated components, the system may include other cabinets, work surfaces and shelves that incorporate the general ventilation-related concepts integrated into the illustrated components. For example, cabinets of different sizes, such as different heights, widths or depths may be provided. The cabinets may be provides with different doors and/or different shelving configurations. A variety of alternative work surfaces may be provided to work with different cabinets. In addition to base cabinets, standard upper cabinets and tall upper cabinets, the wall system 10 may also include cabinets that extend the full height of the wall system 10. Where upper cabinets are not desired, it the wall system 10 may terminate mid-height, as shown above the extended countertop support in FIG. 1.

Directional terms, such as "vertical," "horizontal," "top," "bottom," "upper," "lower," "inner," "inwardly," "outer" and "outwardly," are used to assist in describing the invention based on the orientation of the components shown in the illustrations. The use of directional terms should not be interpreted to limit the invention to any specific orientation (s).

A. Framework.

As noted above, the wall system 10 includes a framework 20 that is mounted to an existing wall (or other support structure) and provides a structure for mounting a wide variety of modular wall system components, such as base cabinets 12*a-b*, work surface 14, standard upper cabinet 16 and tall upper cabinets 17. In the illustrated embodiment, the framework 20 is modular having upper and lower frame assemblies, 30 and 32 respectively, that can be joined together to form the overall framework 20. For example, an upper frame assembly 30 can be joined with a lower frame assembly 32 to form the full height of the wall system 10. Further, adjacent frame assemblies 30 and 32 may be joined to expand the width of the wall system 10. For example, a plurality of side-by-side lower frame assemblies 32 can be joined together to form the full width of the wall system 10.

Figures 4A, 4B, 4C:
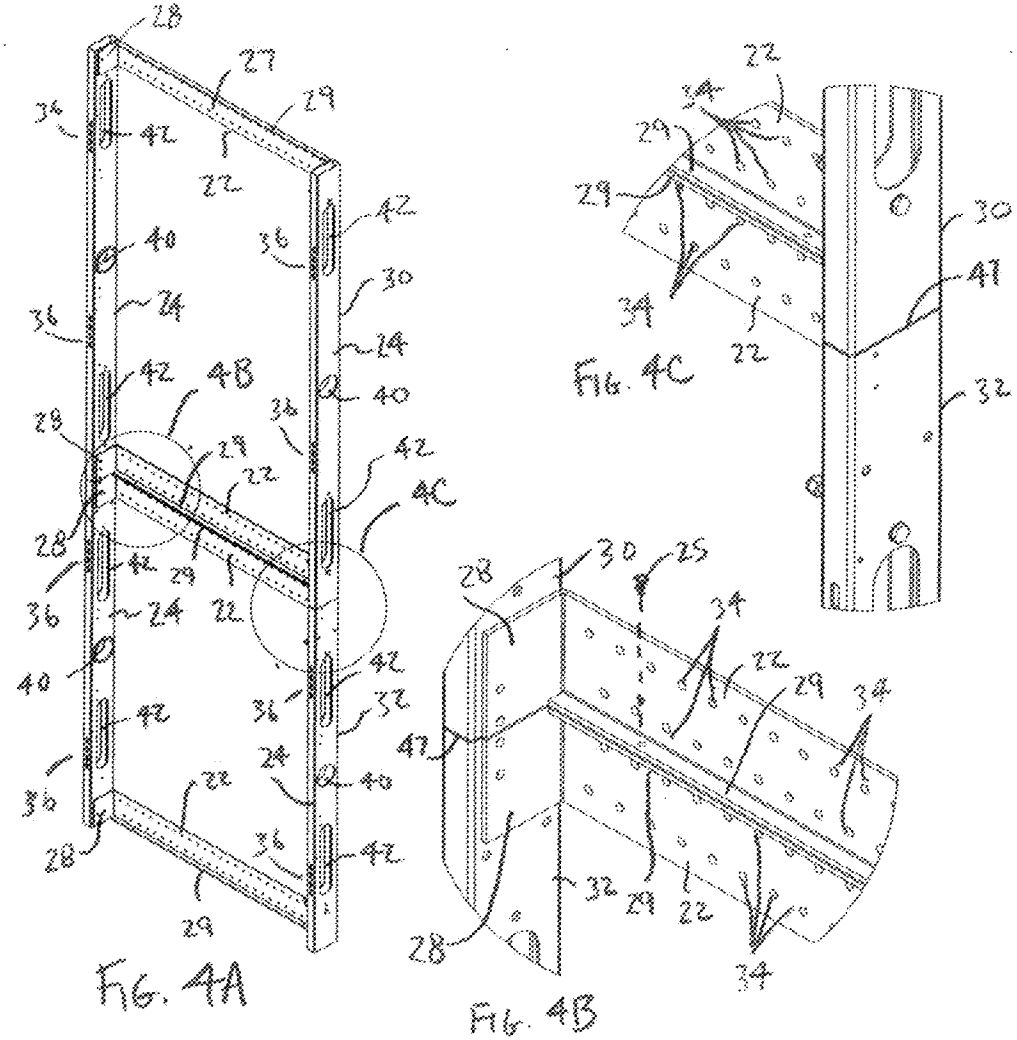
FIG. 4A is a perspective of an upper frame assembly joined to a lower frame assembly.
FIG. 4B is an enlarged view of area 4B of FIG. 4A.
FIG. 4C is an enlarged view of area 4C of FIG. 4A.
Figure 6:
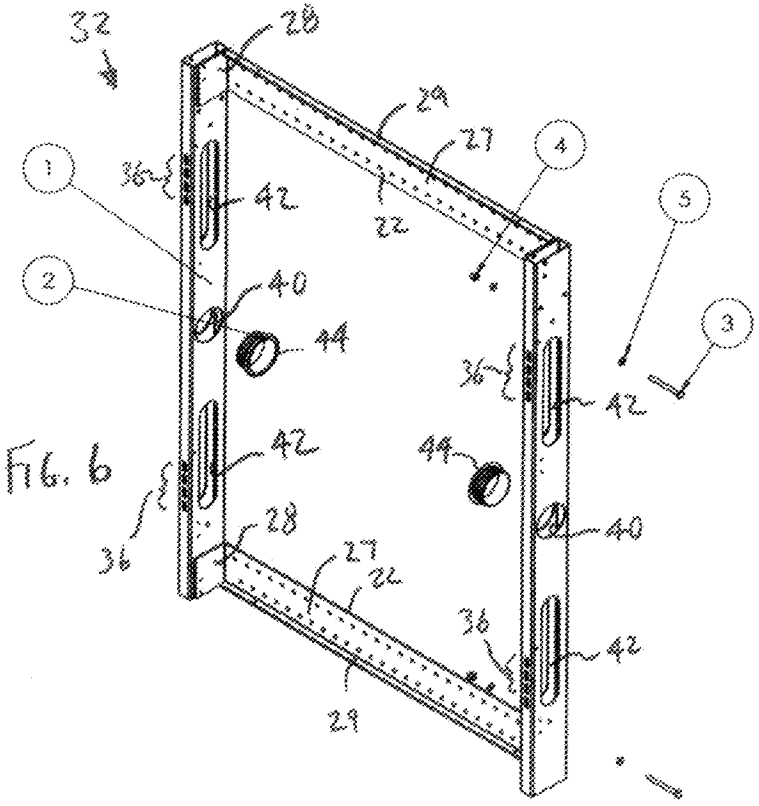
FIG. 6 is an exploded perspective view of a lower frame assembly.
Figure 5:
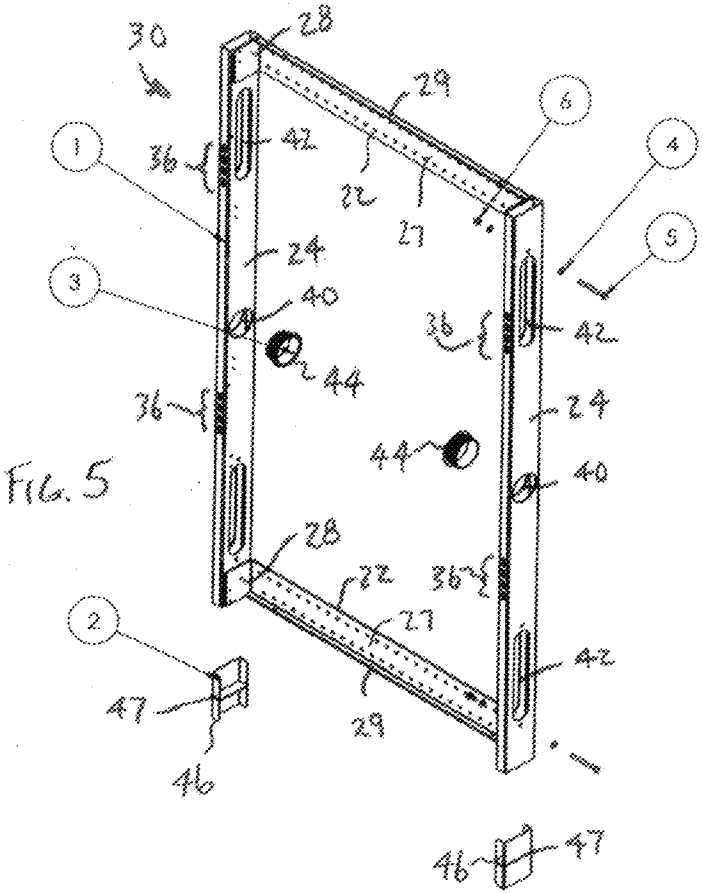
FIG. 5 is an exploded perspective view of an upper frame assembly and connectors.

In the illustrated embodiment, each modular frame assembly 30 and 32 generally includes a pair of horizontal rails 22 and a pair of vertical brackets 24. The horizontal rails 22 have a generally flat central portion 27 and a pair of attachments legs 28 at opposite ends. The flat central portion 26 minimizes interference to the air flow path. The attachment legs 28 extend forwardly at about 90 degrees relative to the central portion 27 to provide a structure for securing the horizontal rails 22 to the vertical brackets. The attachment legs 28 may be secured to the vertical brackets 24 by welding or by fasteners, such as bolts or screws. The horizontal rails 22 are configured to be mounted to the wall by, for example, fasteners, such as lag bolts or screws that extend directly into the wall studs. To facilitate mounting, the horizontal rails 22 define an array of offset mounting holes 34. The mounting holes 34 are arranged so that at least one mounting hole will align with each wall stud. In the illustrated embodiment, each frame assembly 30 included one horizontal rail 22 toward the top of the assembly and one horizontal rail 22 toward the bottom of the assembly. The number and location of horizontal rails 22 may, however, vary from application to application. In the illustrated embodiment, the horizontal rails 22 also include a support lip 29 that extends along the length of the central portion 27. In this embodiment, the support lip 29 extends at about ninety degrees relative to the central portion 27 and is relatively narrow to limit interference with the flue 26. In this embodiment, the horizontal rail 22 at the bottom of each frame assembly 30, 32 may be oriented so that its support lip 29 is on the bottom and the horizontal rail 22 at the top of each frame assembly 32 may be oriented so that its support lip 29 is on the top. The two support lips 29 of stacked upper and lower frame assemblies 30, 32 may be joined by fasteners, such as bolts or screws, or by welding. For example, as shown in FIG. 4B, adjacent support lips 29 of stacked upper and lower frame assemblies 30, 32 may be joined by screws 25 located near opposite ends.

In the illustrated embodiment, the horizontal rails 22 are manufactured from sheet stock, such as sheet metal having a thickness of about 10 gauge. The stock material for the horizontal rails 22 may vary from application to application as desired. Although it is generally desirable to limit the thickness of the horizontal rails 22 to limit interference with the flues 26, the horizontal rails 22 may have increased thickness provided that they do not unacceptably interfere with air flow through the flues 26.

As noted above, each frame assembly 30 and 32 includes a pair of vertical brackets 24. The vertical brackets 24 are mounted to and extend forwardly from the horizontal rails 22. The vertical brackets 24 perform a variety of functions. For example, they provide a mounting structure for the various wall system components. As another example, they have significant depth and create vertically extending flues 26 to provide air flow and provide a space for routing wires and other items. The vertical brackets 24 are of sufficient depth so that each pair of adjacent vertical brackets 2 provides a flue 26 of the appropriate cross-sectional size to provide adequate ventilation for the intended application. The cross-sectional size should be selected to account for cords, wiring, supply lines and other items that might be routed through the flues 26. The outer face of each vertical bracket 24 may include a plurality of mounting featured that allow wall system components to be easily mounted to the framework 20. In the illustrated embodiment, the mounting features include a plurality of sets of slots 36 that are capable of receiving mounting fingers 38 extending from the wall system components. The number and location of the sets of slots 36 may be standardized to allow all wall system components to be mounted using the same sets of slots 36. Alternatively, the vertical brackets 24 may include a larger array of slots that are capable of receiving mounting fingers 38 disposed in a variety of alternative locations.

To facilitate the routing of wires (e.g. electrical wires, communications wires) and other items in a side-to-side direction, the vertical brackets 24 may include a plurality of openings, such as circular holes 40 and elongated holes 42. If desired, grommets 44 or other liners may be fitted into the holes 40 and 42 to protect the wires and other routed items from damage that could result from direct contact with the edges of the holes 40 and 42. The number, size, shape and location of wire routing holes 40 and 42 may vary from application to application, as desired.

In the illustrated embodiment, the vertical brackets 24 are manufactured from lengths of rectangular steel tube having a width of about 1", a depth of about 3" and a wall thickness of about 14 gauge. The stock material may, however, vary from application to application. For example, tubes of other sizes or shapes, extrusions of various configurations ("I" or "C" shaped extrusions) or solid materials may be used as the stock material for the vertical brackets 24.

The upper and lower frame assemblies 30 and 32 may be joined by connectors or other similar structures. In the illustrated embodiment, upper and lower frame assemblies 30 and 32 are interconnected by internal connectors 46 (See FIGS. 4A and 4B). The internal connectors 46 may be configured to fit snugly into the interior of the vertical brackets 24. In the illustrated embodiment, the upper half of the connector 46 is intended to be fitted into the lower end of the vertical bracket 24 of the upper frame assembly 30 and the lower half of the connector is intended to be fitted into the upper end of the vertical bracket 24 of the lower frame assembly 32. As shown in FIG. 4B, the internal connectors may be somewhat "C"-shaped in cross section and may include a central lip 47 that function as a stop when fitting the internal connector 46 into the vertical brackets 24. The internal connectors 46 may be secured in place. For example, the internal connectors 46 may be secured to the upper frame assembly 30 and the lower frame assembly 32 by fasteners, such as screws, or by welding. Although illustrated embodiment includes internal connectors 46, other types of connectors may be used, such as external connectors. In some embodiments, the frame assemblies may be welded together.

Although the illustrated framework 20 is assembled from an arrangement of modular frame assemblies, the design and configuration of the framework 20 may vary from application to application. For example, instead of dividing the framework 20 into upper and lower frame assemblies that are joined to produce the full height, the wall system may utilize full-height frame assemblies in which horizontal rails 22 are mounted across a pair of full-height vertical brackets 24. As another example, instead of joining side-by-side frame assemblies by abutting adjacent vertical brackets 24, side-by-side frame assemblies may share a common vertical bracket 24 that is twice the width and has two sets of mounting slots 36.

B. Base Cabinets.

The wall system 10 may include a variety of furniture components that can be mounted to the framework 20 in various configurations to provide highly customizable furniture system. Generally, the wall system 10 may include base cabinets, upper cabinets (standard and tall) and riser sections. The wall system 10 may also include other components, such as an extended countertop support (described in more detail below). The riser section may include access panels that mount to and cover the vertical brackets to maintain a closed flue from the base cabinets to the standard upper cabinets or to the top ventilation. In the illustrated embodiment, the wall system 10 includes base cabinets 12*a-b*, a work surface 14, a standard upper cabinet 16 and a tall upper cabinet 17 that includes a plurality of shelves 18. The illustrated base cabinets 12*a-b* are of approximately the same width as one lower frame assembly 32. This allows a single base cabinet to be mounted to a lower frame assembly 32. The base cabinets 12*a-b* need not correspond in width to a single lower frame assembly 32. For example, the wall system 10 may include base cabinets that correspond in width with a multiple of lower frame assemblies 32, such as two.

In general, the base cabinets 12*a-b* are capable of being mounted to the wall brackets 24 at or near the floor. Each base cabinet 12*a-b* may be in fluid communication with the flue 26 defined by the corresponding wall brackets 24. The flues 26 provide an air flow paths for heat generated by components within the cabinets to flow up and out of the cabinets and the wall system. In some applications, the cabinets may include a rear wall. If so, the rear wall may be sufficiently perforated to allow air to flow from the interior of the cabinet into the flue. In other applications, the cabinet may not include a rear wall and interior of the cabinet may simply be open to the flue. In some applications, a base cabinet may not be intended for use with heat generating components. In such applications, the base cabinet may include a rear wall. Even when not ventilated, the rear wall of the base cabinet may include openings for wires, cords and other items that might be routed through the flues 26.

Figure 9A:
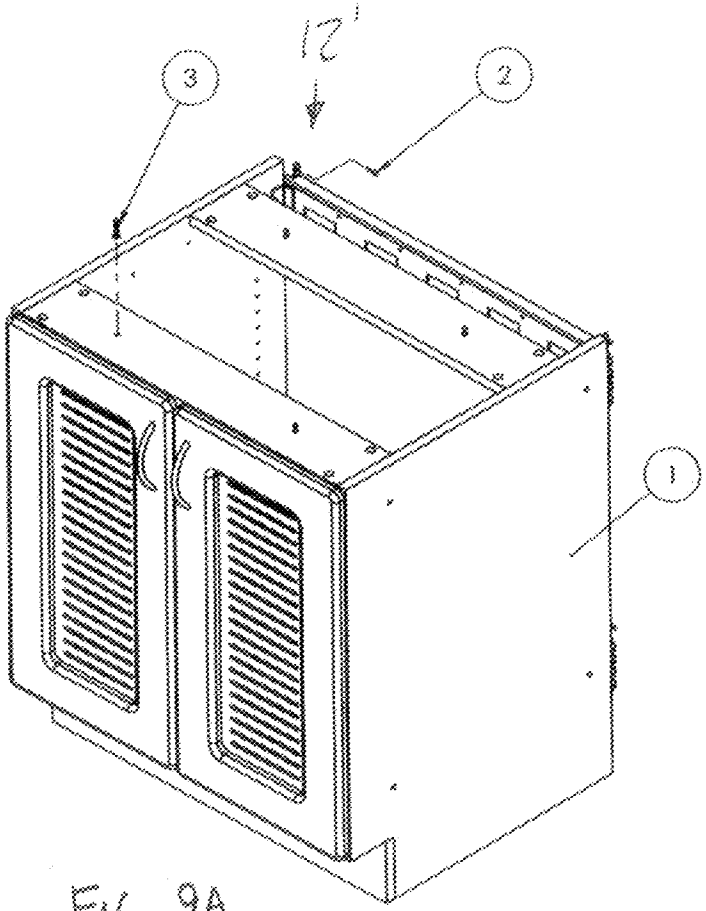
FIG. 9A is a front perspective view of an alternative base cabinet.
Figure 9B:
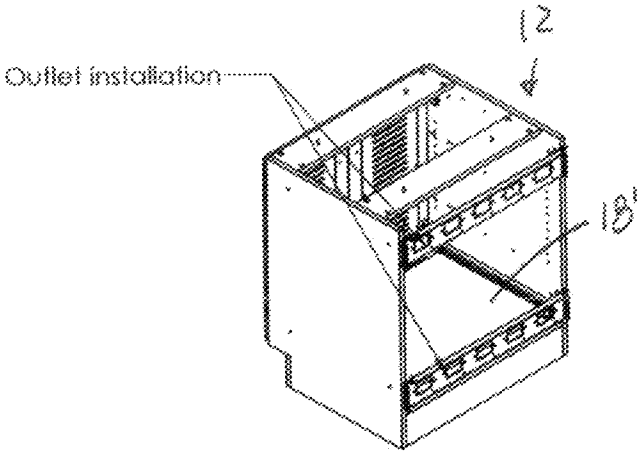
FIG. 9B is a rear perspective view of an alternative base cabinet.
Figure 9C:
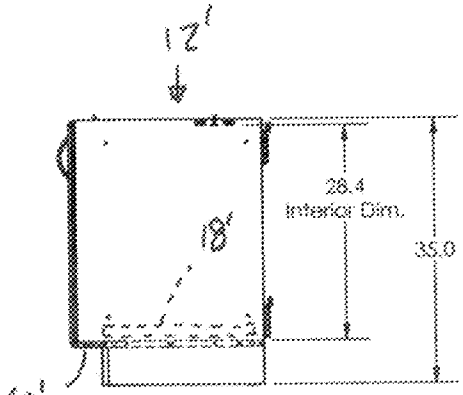
FIG. 9C is a side view of an alternative base cabinet.

In the illustrated embodiment, base cabinets 12*a-b* provide a generally enclosed spaced with doors 48 that can be opened and closed to provide selective access to items housed in the cabinet 12*a*. Lock can be added to the doors 48, if desired. Each base cabinet 12*a-b* generally includes a pedestal 50, a bottom 52, a pair of side walls 54, a pair of top supports 56, a pair of doors 48 and a pair of mounting brackets 58. In this embodiment, the pedestal 50 is configured to rest on the floor. As shown in FIG. 3B, the pedestal 50 may include a plurality of adjustable height legs 51. An adjustable height leg 51 may be disposed in each corner of the pedestal 50. The size, shape and configuration of the pedestal 50 may vary from application to application as desired. The bottom panel 52 is positioned above the pedestal 50 to form the bottom surface of the interior of the cabinet 12*a-b*. The bottom 52 may include a forward overhang 60 that extends forwardly beyond the forward-most extent of the pedestal 50. This may be best seen in FIG. 3A. The forward overhang 60 may be perforated to provide an inlet vent to allow air to enter the interior of the cabinet 12*a* from the surrounding environment. In use, the ventilated forward overhang 60 allows air to enter the interior of the cabinet at the lower front, which routes air flow over components housed in the cabinet as it flows upwardly and rearwardly from the inlet to the flue 26. The side walls 54 form the sides of the cabinet 12*a-b* and, in this embodiment, extend to the floor and are an integral part of the pedestal 50. As shown, the side walls 54 of this embodiment are notched to follow the shape of the pedestal 50 and the forward overhang 60. The base cabinet 12*a-b* may be configured to receive one or more adjustable shelves 62. To allow for adjustable shelves 62, the side walls 54 may include a plurality of holes 63 capable of receiving shelf supports 64. As an alternative to holes 63, shelf support brackets may be installed inside the cabinet 12*a*. The cabinet 12*a-b* may include other types of shelves. For example, the adjustable shelve(s) 62 may be replaced by one or more pull-out shelves mounted on appropriate shelf or drawer slides. FIGS. 9A-C show an alternative base cabinet 12' that includes a single pull-out shelf 18' located just above the bottom of the cabinet 12'. The pull-out shelf 18' may terminate short of the forward overhang 60' to facilitate entry of air into the cabinet through the venting located in the overhang 60. In addition (or alternatively), the pull-out shelf 18' may itself be vented to allow air flow through the shelf to any heat generated components resting on the shelf 18'. Returning now base cabinet 12*a*, the top supports 56 extend from side wall 54 to side wall 54 to, among other things, provide structural integrity and a mounting surface for any components mounted above, such as a work surface. The number, size, shape and configuration of the top supports 56 may vary from application to application. In this embodiment, base cabinet 12*a-b* includes ventilated doors 48. The ventilated doors 48 allow air to enter the interior of the cabinet from the surrounding environment. This air may be drawn over components housed in the cabinet as it flows to the flue 26. Ventilated doors 48 may be used in addition or as an alternative to perforations in the forward overhang 60 of the cabinet bottom 52.

The cabinet 12*a-b* includes a pair of mounting brackets 58 that extend from side-to-side across the rear of the cabinet 12*a-b*. One mounting bracket 58 is mounted toward the top of the cabinet 12*a-b* and the other is mounted toward the bottom of the cabinet 12*a-b*. In the illustrated embodiment, the various upper and lower cabinets are secured to the vertical brackets 24 by essentially identical mounting brackets 58. The mounting brackets 58 are configured to be mounted to the cabinets, for example, by bolts, screws or other fasteners. In this embodiment, each mounting bracket 58 includes a pair of "L"-shaped cabinet brackets 72 that are secured to opposite ends of the mounting bracket 58. The illustrated cabinet brackets 72 define mounting holes 74 for securing the mounting bracket 58 to the cabinet side walls 52 with screws (not shown). The mounting brackets 58 include mounting fingers 38 that are configured to be fitted into corresponding slots 36 in the vertical brackets 24. Although the illustrated embodiment includes an arrangement of four mounting slots 36 and four fingers 38 at each attachment point, the mounting features may vary from application to application. For example, the location of the slots 36 and fingers 38 may be reversed (i.e. the finger may be on the vertical bracket 24 and the slots may be on the cabinet mounting bracket 58. This is just one example and it should be understood that the number, size, location, shape or configuration of the mounting features may vary. The mounting brackets 58 of the illustrated embodiment also include set screws 66 that secure the mounting brackets 58 to the vertical brackets 24. The set screws 66 may be mounted in tabs 76 and may be configured to extend into corresponding holes 67 in the vertical brackets 24. In the illustrated embodiment, the mounting brackets 58 are configured to support electrical outlets or similar components, such as fluid supply ports (e.g. gas, water or air supply ports). To that end, the mounting brackets 58 include a plurality of outlet openings 70 with corresponding outlet box mounting holes 80. The mounting brackets 58 of the illustrated embodiment include five outlet openings 70 spaced evenly across the width of the mounting brackets 58. The outlet openings 70 are sized and shaped to receive a conventional outlet box (not shown). The outlet opening 70 will preferably, but not necessarily, be fitted with a shallow outlet box that minimizes impact on the air flow path. The number, size, shape and spacing of the outlet openings 70 may vary from application to application. In addition or alternative to the outlet openings 70, the mounting bracket 58 may be provided with mounting openings for other components that might be mounted to the mounting bracket 58. In the illustrated embodiment, the outlet openings 70 that are not in use may be covered by a blank cover plate.

In the illustrated embodiment, the base cabinets 12*a-b* are intended to rest on the floor. If desired, the base cabinets may alternatively be suspended above the floor by the framework 20. In suspended embodiments, the bottom 52 may be ventilated to allow air to enter the cabinet 12*a-b* and pass across any housed electronic components as it flows to the flue 26. The bottom ventilation may be positioned toward the front of the cabinet to help increase the length of the air flow path over the components, but it is not restricted to the front of the cabinet. For example, if desired, the entire bottom may be perforated.

Figure 10A:
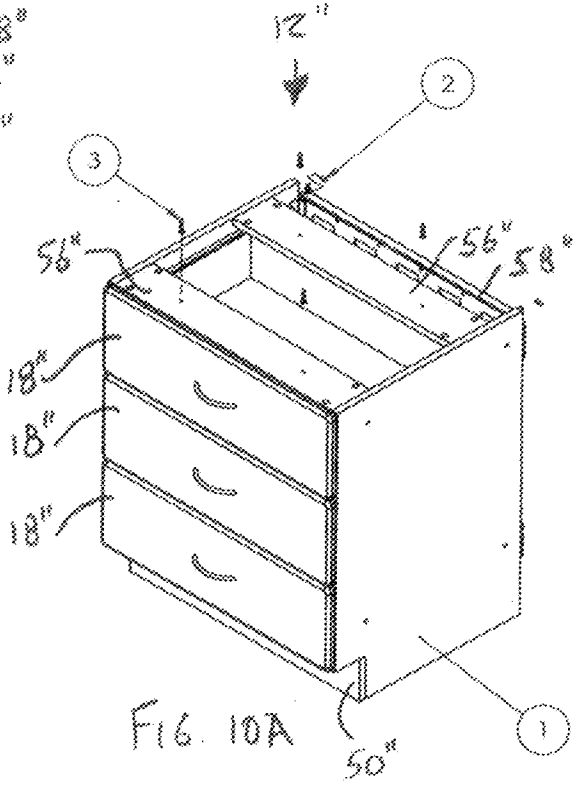
FIG. 10A is a front perspective view of a second alternative base cabinet.
Figure 10B:
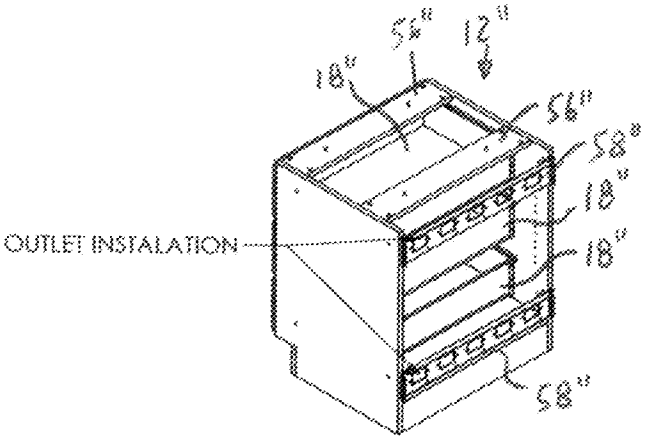
FIG. 10B is a rear perspective view of a second alternative base cabinet.
Figure 10C:
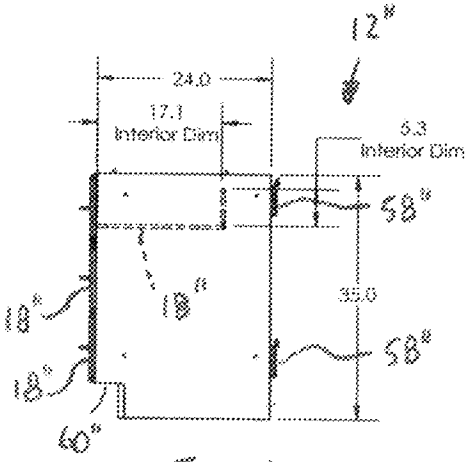
FIG. 10C is a side view of a second alternative base cabinet.
Figure 11B:
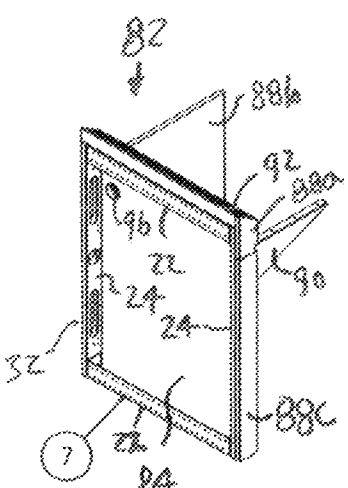
FIG. 11B is a rear perspective view of an extended countertop support.
Figure 11A:
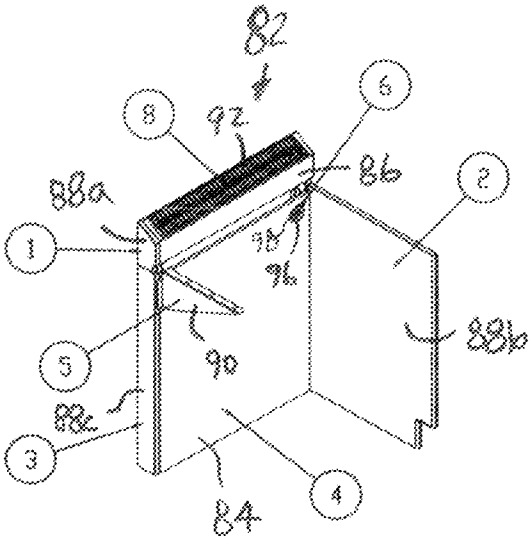
FIG. 11A is a front perspective view of an extended countertop support.

As noted above, the wall system 10 is intended to be a modular system that includes a variety of alternative components that can be assembled in different ways to produce customized furniture solutions. To that end, the wall system 10 may include a variety of alternative types of base cabinets. For example, FIGS. 10A-C show an alternative base cabinet 12" that includes a plurality of pull out drawers 18". This alternative base cabinet 12" is essentially identical to base cabinet 12*a-b* (except as set forth below) and therefore will not be described in detail. Suffice it to say that base cabinet 12" generally includes a pedestal 50", a pair of side walls 54", a pair of top supports 56", a pair of mounting brackets 58" and a plurality of drawers 18". Although not generally ventilated, the drawer base cabinet 12" may be ventilated, if desired, to ventilate items contained in the drawers. For example, the forward overhang 60" may be ventilated, and the drawer fronts, drawer bottoms and/or drawer backs may be ventilated.

Figure 12A:
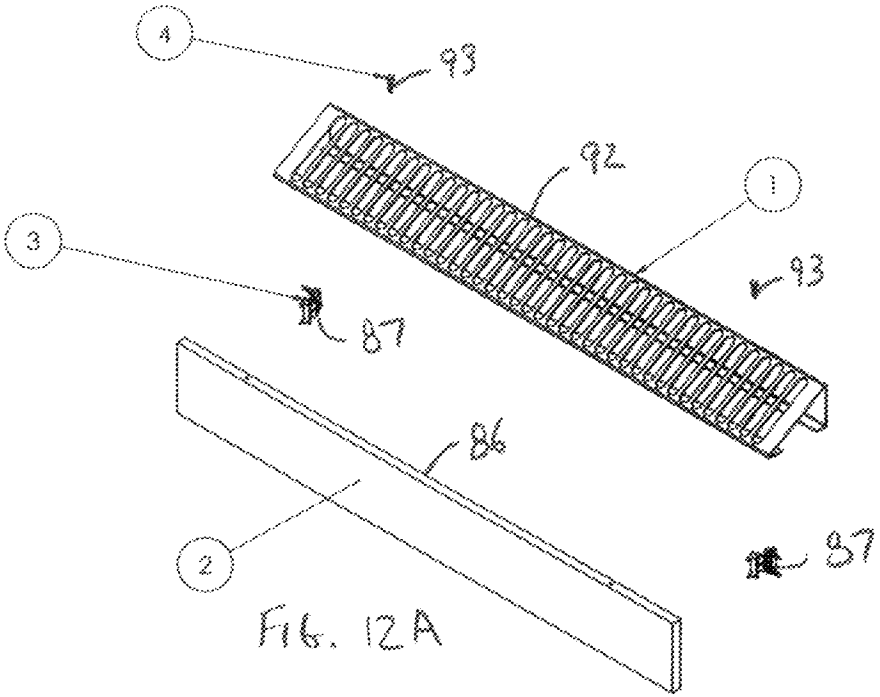
FIG. 12A is an exploded perspective view of a vented top cap for the extended countertop support.
Figure 12B:
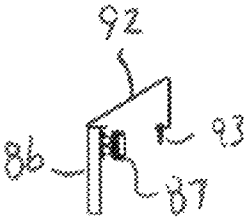
FIG. 12B is a side view of the top cap, backsplash panel and mounting clip assembly.
Figure 13A:
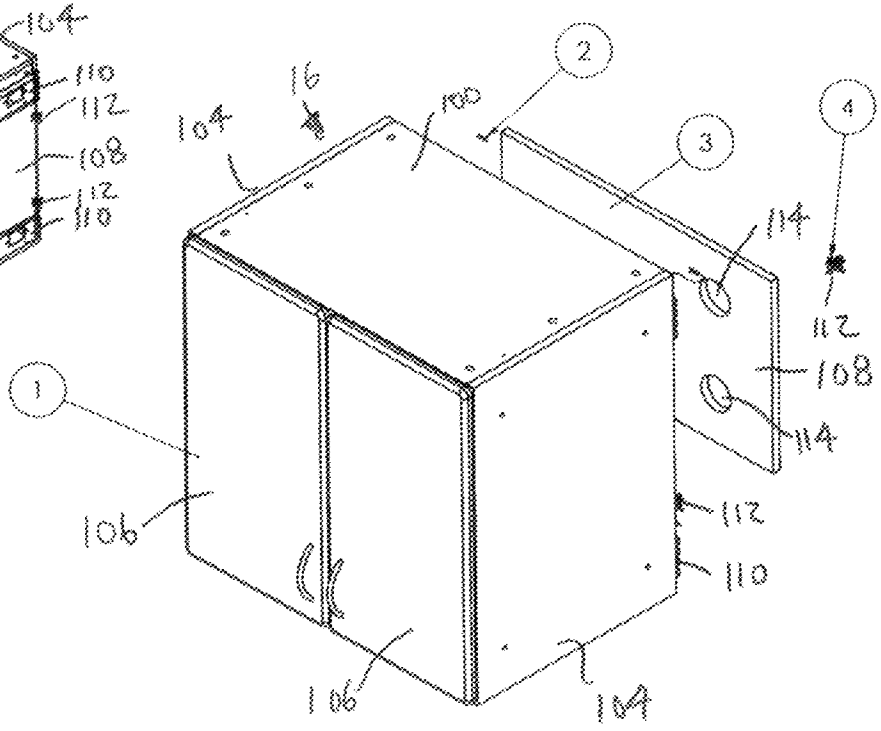
FIG. 13A is a front perspective view of a standard upper cabinet.
Figure 13B:
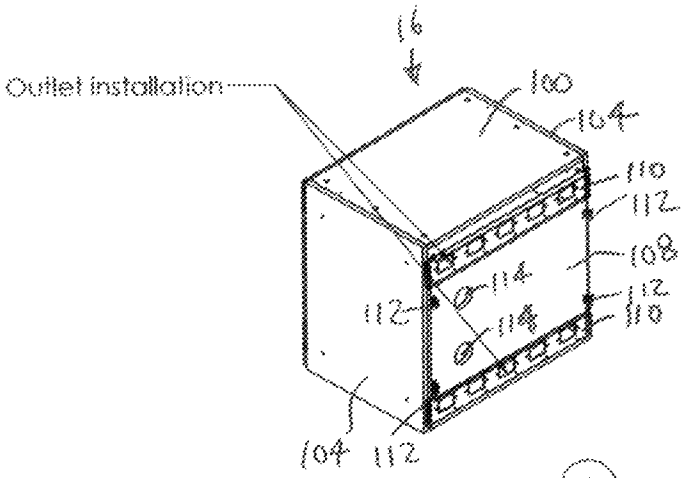
FIG. 13B is a rear perspective view of a standard upper cabinet.
Figure 14A:
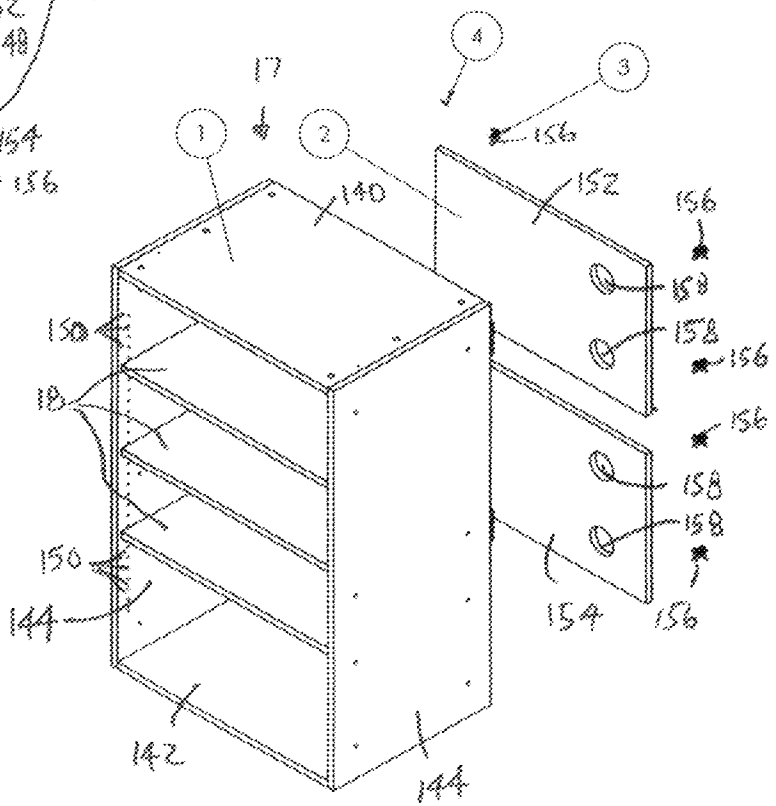
FIG. 14A is an exploded front perspective view of a tall upper cabinet.
Figure 14B:
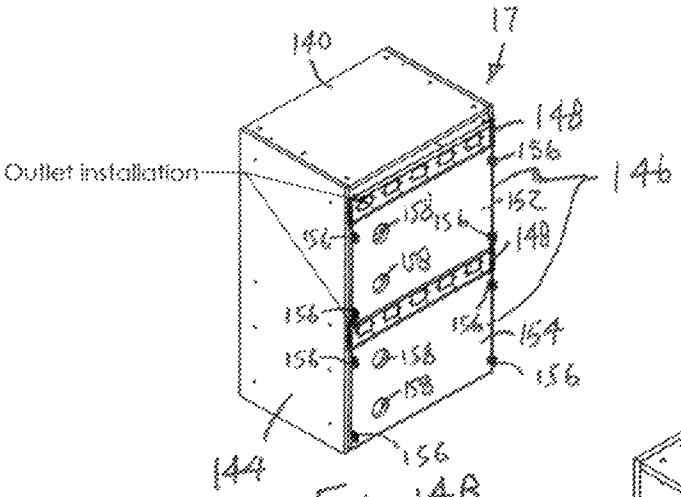
FIG. 14B is a rear perspective view of the tall upper cabinet.
Figure 15C:
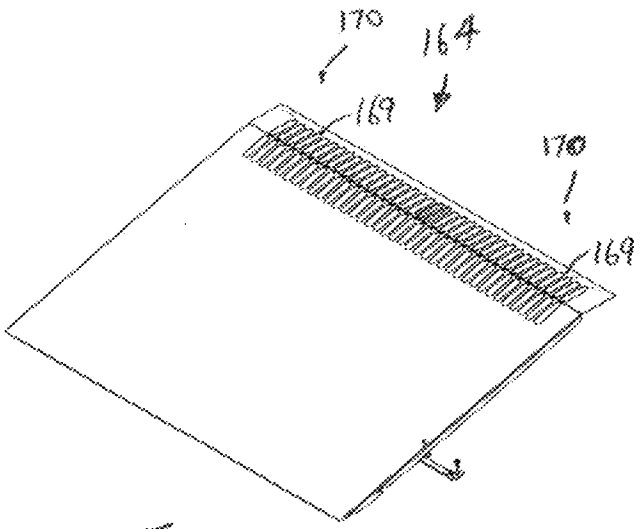
FIG. 15C is a perspective view of the ventilation top cap.
Figure 15B:
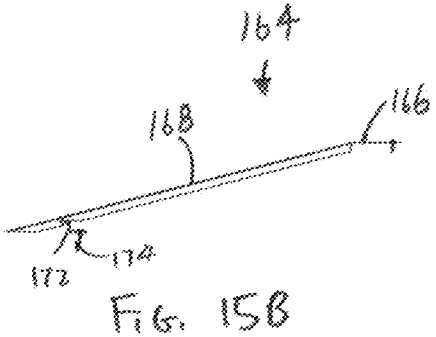
FIG. 15B is a side view of the ventilation cap.
Figure 15A:
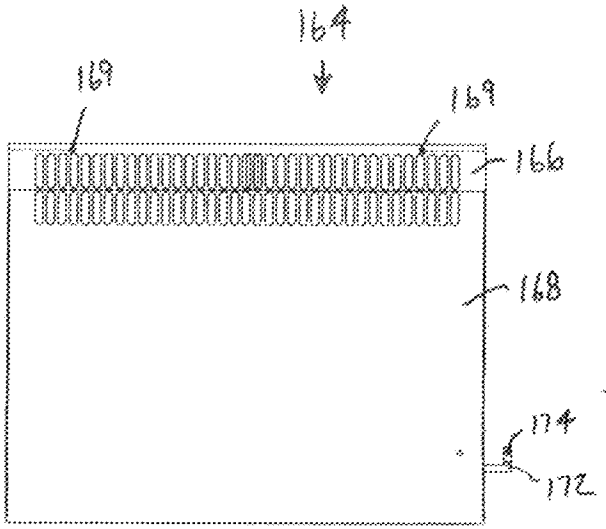
FIG. 15A is a top plan view of a ventilation cap.

In addition to base cabinets, the wall system 10 may include an extend countertop support 82 that provides structural support for an extended work surface 14. The countertop support 82 generally includes a lower frame assembly 32, a removable access panel 84, a backsplash panel 86, a plurality of beauty panels 88*a-c*, a counter bracket 90 and a vented top cap 92. The lower frame assembly of the extended support 82 is essentially identical to the lower frame assembly 32 previously described, except that it is not joined to a corresponding upper frame assembly 30. Instead, the upper end of the lower frame assembly 32 terminates above the work surface 14 and is fitted with various components. More specifically, the upper end of the lower frame assembly 32 is fitted with a backsplash panel 86 that closes the front of the flue 26, a beauty panel 18*a* and vented top cap 92. As shown in FIGS. 12A and 12B, the vented top cap 92 is generally triangular in cross section. The forward edge of the vented top cap 92 is secured to the backsplash panel 86, and the rear edge of the vented top cap 92 is mounted to the support lip 29 at the top of the upper horizontal rail 22. For example, the rear of the vented top cap 92 may be secured to the support lip 29 by fasteners, such as screws 93. The backsplash panel 86 may be mounted to the vertical brackets 24 by clips 87 that are capable of being snap fitted to the backsplash panel 86 and to the vertical brackets 24. The backsplash panel 86 can be mounted using alternative components (e.g. screws), if desired. The removable access panel 84 is mounted to the front of the vertical brackets 24 to close the front of the flue 26. In the illustrated embodiment, the removable access panel 84 is mounted by clips (not shown) that are capable of being snap fitted to the access panel 84 and to the vertical brackets 24. The access panel 84 can be mounted using alternative components (e.g. screws), if desired. The access panel 84 may define one or more opening 96 that allow wires or other items to be routed through the access panel 84. The opening 96 may be fitted with a grommet 98, if desired. The counter bracket 90 is mounted to the lower frame assembly 32 (e.g. by fasteners or by welding) and is configured to be secured to the undersurface of the work surface 14, for example, by screws. Other beauty panels 88*b-c* may be installed to close off the lower frame assembly 32 and/or improve aesthetics. These panels 88*b-c* may be mounted by clip (not shown) or by other fasteners.

C. Standard Upper Cabinets.

The wall system 10 may include upper cabinets that are mounted above the base cabinets and are intended to provide elevated storage or other functions. In the illustrated embodiment, the wall system 10 includes standard upper cabinet 16 and tall upper cabinets 17. The standard upper cabinets 16 are spaced vertically above the work surface 14 and utilize a removable access panel 84 to close the front of the flue 26 in the gap between the work surface 14 and the standard upper cabinets 16. The tall upper cabinets 17 extend from the work surface 14 to the top of the wall system 10, thereby eliminating any gap.

The standard upper cabinet 16 is similar to the base cabinet 12*a*, except as described or shown. The upper cabinet 16 of the illustrated embodiment generally includes a top 100, a bottom 102 (see FIG. 3B), a pair of side walls 104, a pair of doors 106, a rear wall 108 and a pair of mounting brackets 110. The top 100, bottom 102 and side walls 104 are mounted together to form the general structure of the upper cabinet 16. The doors 106 may be mounted to the side walls 104 to allow the upper cabinet 16 to be selectively opened and closed. The doors 106 may include a lock, if desired. The upper cabinet 16 may be configured to receive one or more adjustable shelves 118 (see FIG. 3B). To allow for adjustable shelves, the side walls 104 may include a plurality of holes (not numbered) capable of receiving shelf supports (not numbered). As an alternative to holes, shelf support brackets may be installed inside the cabinet 16.

As with the base cabinets 12*a-b*, the upper cabinet 16 includes a pair of mounting brackets 110 that extend from side-to-side across the rear of the upper cabinet 16. One mounting bracket 110 is mounted toward the top of the upper cabinet 16 and the other is mounted toward the bottom of the upper cabinet 16. The mounting brackets 110 are essentially identical to the mounting brackets 58 described above in connection with base cabinets 12*a-b*. Accordingly, mounting brackets 110 will not be described in detail.

The upper cabinet 16 includes a rear wall 108. In this embodiment, the rear wall 108 is a panel that mounts directly to the vertical brackets 24. More specifically, the rear wall 108 may be joined to the vertical brackets 24 by a plurality of clips 112, for example, one located toward each corner of the rear wall 108. The clips 112 may be replace or supplemented with other mounting components, such as screws (not shown) that extend through the rear wall 108 into the vertical brackets. The rear wall 108 may include one or more holes 114 that allow cords, wiring or other items to be fed pass through the rear wall. Any holes 114 provided in the rear wall 108 may be fitted with grommets (not shown), if desired.

As can be seen, the illustrated upper cabinet 16 is not configured for ventilation. If desired, the upper cabinet 16 can be ventilated. For example, the rear wall 108 can be removed or ventilated to provide a flow path to the flue 26, and the bottom 102 and/or doors 106 may be ventilated to allow air from the room to enter the interior of the upper cabinet 16.

D. Tall Upper Cabinets.

As noted above, the wall system 10 may also include tall upper cabinets 17. In the illustrated embodiment, the wall system 10 includes a tall upper cabinet 17 that runs from the work surface 14 to the full height of the wall system 10. The tall upper cabinet 17 of this embodiment includes a plurality of shelves 18. Although no doors are shown in this embodiment, door may be added to the tall upper cabinet 17, if desired.

The tall upper cabinet 17 of the illustrated embodiment generally includes a top 140, a bottom 142, a pair of side walls 144, a rear wall 146 and a pair of mounting brackets 148. The top 140, bottom 142 and side walls 144 are mounted together to form the general structure of the tall upper cabinet 17. The tall upper cabinet 17 is configured to receive a plurality of adjustable shelves 18. To allow for adjustable shelves, the side walls 144 may include a plurality of holes 150 capable of receiving shelf supports (not shown). As an alternative to holes, shelf support brackets may be mounted to the side walls 144 of the tall upper cabinet 17.

The tall upper cabinet 17 is mounted to the vertical brackets 24 by mounting brackets 148. The mounting brackets 110 of the illustrated embodiment extend from side-to-side across the rear of the tall upper cabinet 17. One mounting bracket 148 is mounted toward the top of the tall upper cabinet 17 and the other is mounted just below the middle of the tall upper cabinet 17. The mounting brackets 148 are essentially identical to the mounting brackets 58 described above in connection with base cabinets 12*a-b*, and therefore will not be described in detail.

As with upper cabinet 16, the tall upper cabinet 17 includes a rear wall 146 that is mounted to the vertical brackets 24. In this embodiment, the rear wall 146 includes two panels 152 and 154 that are separately mounted to the vertical brackets 24. In this embodiment, the two panels 152, 154 of the rear wall 146 are joined to the vertical brackets 24 by a plurality of clips 156. The clips 156 may, for example, be located in the corners of the two rear wall panels 152, 154. The clips 156 may be replace or supplemented with other mounting components, such as screws (not shown) that extend through the two rear wall panels 152, 154 into the vertical brackets. The two rear wall panels 152, 154 may include one or more holes 158 that allow cords, wiring or other items to be fed pass through the rear wall 146. Any holes 114 provided in the rear wall 108 may be fitted with grommets (not shown), if desired.

The tall upper cabinet 17 of the illustrated embodiment is not configured for ventilation. If desired, the tall upper cabinet 17 can be reconfigured to provide ventilation through the corresponding flue 26. For example, the rear wall 146 (one or both panels 152, 154) can be removed or ventilated to provide a flow path to the flue 26. If doors are added to the tall upper cabinet 17, the doors may be ventilated to allow air from the room to enter the interior of the upper cabinet 16.

E. Ventilated Top Cap.

The top of the wall system 10 is closed by a ventilated top cap that allows warm air flowing up through the flues 26 to vent into the surrounding environment. In the illustrated embodiment, the wall system 10 includes a number of components that are combined to provide a vented headspace 160 at the top of the wall system 10. The headspace 160 of this embodiment is defined by a pair of beauty panels 162 that close opposite ends of the headspace 160 and one or more ventilation caps 164 that close the top and front of the headspace 160. The ventilation caps 164 are mounted at the rear to the upper frame assembly 30 and at the front to the top of the upper cabinets 16 and 17. In this embodiment, the ventilation cap 164 provides the wall system 10 with an angled top. As perhaps best shown in FIGS. 3A-3C, the upper frame assembly 30 extends upwardly beyond the top of the upper cabinets 16 and 17. This provides an elevated rear support surface for the ventilation caps 164. The ventilation cap 164 generally includes a flat rear portion 166 and an angled forward portion 168. The flat rear portion 166 rests on the upper end of the vertical brackets 24. The flat rear portion 166 also includes a plurality of holes 168 that allow the ventilation cap 164 to be secured to the support lip 29 of the top horizontal rail 22 by screws 170. The ventilation cap 164 also includes legs 172 that extend down from the angled portion into engagement with the top of the upper cabinets 16 and 17. The legs 172 may be secured to the top of the upper cabinets 16 and 17 by screws 174. In the illustrated embodiment, ventilation openings are formed in the flat rear portion 166 and the angled forward portion 168. The number, size, shape and configuration of the ventilation openings may vary from application to application.

In the illustrated embodiment, the wall system 10 is capable of relying on natural convection to move air through the system to cool housed electronics. This can be particularly important in some applications where fans are not permissible, such as in a surgical environment. In such application, heat generated by electronics or other heat generating components housed in the base cabinets 12*a-b* will naturally rises up through the flues 26 and out the ventilated caps 164. This movement of heated air simultaneously draws cool air into the cabinets 12*a-b* through the ventilation in the cabinets 12*a-b* (e.g. ventilation in the forward overhang 60 and the doors 48). Although the system 10 can function in many applications using natural convection, one or more fans can be provided to increase air flow through the ventilation system, if desired. For example, a fan may be provided in the headspace 160 to draw air up through the flues 26 and push it out into the environment through the ventilation caps 164. As another example, separate fans may be provided for each flue in which increased airflow is desired. These individual fans may be position essentially anywhere along the flues 26 or even in the base cabinets 12*a-b*, if desired. In applications where heat generating components will be contained in a single cabinet, a fan may be positioned only in the cabinet or the flue associated with the cabinet that houses those heat generating components.

The above description is that of current embodiments of the invention. Various alterations and changes can be made without departing from the spirit and broader aspects of the invention as defined in any appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A modular wall system for attachment to an existing wall, comprising:

a framework comprised of a plurality of modular frame assemblies, said plurality of modular frame assemblies including a plurality of horizontal frame components joined to the existing wall and including a plurality of vertical frame components joined to said plurality of horizontal frame components, wherein said plurality of vertical frame components are adapted to provide a support structure for the wall system;

one or more wall system components mounted to said plurality of vertical frame components of said framework, at least one of said wall system components having an inlet vent disposed toward a front of said wall system component;

a flue defined between said plurality of horizontal frame components of said modular frame assemblies, said vertical frame components of said modular frame assemblies, said existing wall, and a rear of said wall system component, such that said plurality of horizontal frame components are set back from said wall system component; and an outlet vent disposed toward a top of the modular wall system, said flue adapted to draw in a flow of air into said wall system component through said inlet vent and to direct the flow of air out of said outlet vent.

2. The system of claim 1 further comprising a ventilation cap near said outlet vent, said ventilation cap defining a headspace.

3. The system of claim 1 wherein one or more of said wall system components includes a perforated rear wall, and wherein said rear wall and said vertical frame component define said flue.

4. The system of claim 1 wherein said one or more of said wall system components includes an opening in a rear wall adapted to receive cables.

5. The system of claim 1 wherein at least one of said wall system components includes a ventilated door.

6. The system of claim 1 wherein at least one of said wall system components is a base cabinet, said base cabinet having a bottom panel, said bottom panel supported by a pedestal.

7. The system of claim 6 wherein a perforated portion of said bottom panel overhangs said pedestal, said perforated portion adapted to provide an inlet vent for the flow of air into an interior of said base cabinet.

8. The system of claim 7 wherein at least one of said wall system components is an upper cabinet positioned above and spaced apart from said base cabinet, and wherein a riser section is mounted to said framework between said base cabinet and said upper cabinet to maintain said flue.

9. A modular wall system comprising:

a plurality of frame assemblies joined together to form a framework mounted to an existing wall, each of said plurality of frame assemblies include at least one horizontal member and a pair of spaced-apart vertical members mounted to the existing wall, said vertical members extending away from the existing wall a distance that is greater than a distance that said horizontal members extend from the existing wall, whereby said framework defines a vertical flue between each pair of spaced-apart vertical members;

at least one wall system component having a front, a rear and an interior, said at least one wall system component mounted to said vertical members of said framework at said rear such that said horizontal members of said framework are set back from said wall system component, said at least one wall system component defining an inlet toward said front, said inlet placing said interior in fluid communication with an external environment, said at least one wall system component having a rear defining an opening placing said interior in fluid communication with said flue, said vertical flue being further defined between the rear of said wall system component, the existing wall, said vertical members of said framework and said horizontal members of said framework; and a vent defined toward a top of the modular wall system to provide fluid communication between said flue and the external environment, wherein said inlet, said interior, said flue and said vent are arranged to cooperatively define an air flow path that allows convection to draw air through said inlet into said interior, from said interior into said flue and from said flue to the external environment through said vent.

10. The system of claim 9 wherein said frame assemblies are upper assemblies and lower assemblies.

11. The system of claim 10 wherein said upper assembly and said lower assembly are joined together over a height of the system.

12. The system of claim 10 wherein two or more lower assemblies are joined together along a width of the system.

13. The system of claim 9 wherein said upper assembly includes a pair of said vertical members, said lower assembly includes a pair of vertical members, said vertical members of said upper assembly being aligned with said vertical members of said lower assembly, whereby said vertical members of said upper assembly and said vertical members of said lower assembly cooperatively define a single vertical flue.

14. The system of claim 13 wherein said horizontal members have an array of off-set mounting holes configured to align with a wall stud of the existing wall.

15. The system of claim 13 wherein said at least one wall system component cooperates with said vertical members of said framework to define said flue.

16. The system of claim 15 wherein said at least one wall system component includes a perforated rear wall and said vertical brackets and said rear wall defining said flue.

17. The system of claim 9 wherein one of said wall system components is a base cabinet, said base cabinet in fluid communication with said flue.

18. The system of claim 17 wherein said base cabinet includes ventilated doors.

19. The system of claim 17 wherein a pedestal supports said base cabinet and a portion of a bottom panel of said base cabinet overhangs said pedestal, and wherein said overhanging portion of said bottom panel is perforated and a flow of air is drawn into said interior of said base cabinet at a lower front of the system, drawn over any electrical component housed in said interior, into said flue and out through said vent.

20. The system of claim 19 wherein said base cabinet is suspended above a floor.

21. The system of claim 17 wherein one of said wall system components is an upper cabinet positioned above said base cabinet with a riser section therebetween, said riser section adapted to maintain said flue from said base cabinet to said upper cabinet.

22. The system of claim 21 wherein said upper cabinet further comprises a rear wall having openings adapted to receive cables.

23. The system of claim 22 wherein said vertical members define opening for routing cables.

24. A modular wall system with an integrated convection cooling system comprising:

a framework of one or more horizontal supports mounted to an existing wall and one or more elongated vertical brackets; and a wall system component having a front and a rear, said wall system component mounted on said elongated vertical brackets of said framework at said rear and spaced apart from said horizontal supports, said wall system component defining an interior, an inlet toward said front and an outlet toward said rear, said wall system component having a shelf for supporting an electronic component in said interior in a flow path between said inlet and said outlet;

wherein said vertical brackets extend from the existing wall a distance that is greater than a distance that said horizontal supports extend from the existing wall to define a flue with a cross-sectional area defined by a distance between said vertical brackets, said one or more horizontal supports, the existing wall, and the rear of said wall system component, said flue terminating at a vent, said outlet being in fluid communication with said flue, whereby convection draws air from an external environment through said inlet into said interior, then across said shelf through said outlet to said flue and then from said flue through said vent to the external environment.

25. The system of claim 24 wherein said horizontal supports are configured to mount to a stud of the existing wall with fasteners through one or more mounting holes in an array of off-set mounting holes in said horizontal supports.

26. The system of claim 24 wherein a vent cap is positioned at an outlet end of said flue, said vent cap defining a headspace.

27. The system of claim 26 wherein a fan is positioned in said headspace.

28. The system of claim 24 wherein said wall system component is a base cabinet with a rear wall, said outlet defined by one or more perforations in said rear wall.

29. The system of claim 28 wherein said vertical brackets include transverse openings to allow for routing of cables.

* * * * *